US011105521B2

(12) United States Patent
Maeyama

(10) Patent No.: US 11,105,521 B2
(45) Date of Patent: Aug. 31, 2021

(54) OUTDOOR UNIT

(71) Applicant: Mitsubishi Electric Corporation, Tokyo (JP)

(72) Inventor: Hideaki Maeyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 118 days.

(21) Appl. No.: 16/072,033

(22) PCT Filed: Mar. 28, 2016

(86) PCT No.: PCT/JP2016/059862
§ 371 (c)(1),
(2) Date: Jul. 23, 2018

(87) PCT Pub. No.: WO2017/168503
PCT Pub. Date: Oct. 5, 2017

(65) Prior Publication Data
US 2019/0032929 A1 Jan. 31, 2019

(51) Int. Cl.
*F24F 1/30* (2011.01)
*F24F 1/18* (2011.01)
(Continued)

(52) U.S. Cl.
CPC ..... *F24F 1/30* (2013.01); *F24F 1/18* (2013.01); *F25B 1/00* (2013.01); *F25B 39/00* (2013.01);
(Continued)

(58) Field of Classification Search
CPC ..... F28F 2265/12; F28D 1/047; F24F 1/30; F24F 1/18; F25B 1/00; F25B 39/00; F25B 41/00
See application file for complete search history.

(56) References Cited

U.S. PATENT DOCUMENTS 1,858,280 A 5/1932 Resek
6,173,767 B1 * 1/2001 Kennon ..... F16K 17/16 137/68.23
(Continued)

FOREIGN PATENT DOCUMENTS

CN 1182187 A 5/1998
JP 07-332811 A 12/1995
(Continued)

OTHER PUBLICATIONS

Office Action dated Jun. 25, 2019 issued in corresponding JP patent application No. 2018-507829 (and English translation).
(Continued)

*Primary Examiner* — Jon T. Schermerhorn, Jr.
(74) *Attorney, Agent, or Firm* — Posz Law Group, PLC

(57) ABSTRACT

Provided is an outdoor unit for use in a refrigeration cycle apparatus circulating refrigerant mixture inclusive of 1,1,2-trifluoroethylene, the outdoor unit including: a casing; a pipe configured to allow the refrigerant mixture to flow through the pipe, the pipe being accommodated inside the casing and including a bend portion, the bend portion including a breakage-guide structure having a pressure resistance lower than a pressure resistance of rest of the pipe; and a plate interposed between the breakage-guide structure and outside of the casing.

4 Claims, 7 Drawing Sheets

(51) Int. Cl.

| | |
|---|---|
| ***F28F 1/00*** | (2006.01) |
| ***F25B 41/00*** | (2021.01) |
| ***F25B 49/02*** | (2006.01) |
| ***F25B 1/00*** | (2006.01) |
| ***F25B 39/00*** | (2006.01) |
| ***F28D 1/047*** | (2006.01) |
| ***F25B 41/40*** | (2021.01) |

(52) U.S. Cl.

CPC ..... *F25B 41/00* (2013.01); *F25B 41/40* (2021.01); *F25B 49/02* (2013.01); *F28D 1/047* (2013.01); *F28F 1/00* (2013.01); *F28D 1/0477* (2013.01)

(56) References Cited

U.S. PATENT DOCUMENTS

| | | | | |
|---|---|---|---|---|
| 6,820,685 | B1 | 11/2004 | Carter et al. | |
| 2009/0044554 | A1* | 2/2009 | Takeichi ..... | F24F 1/54 62/259.1 |
| 2014/0070132 | A1 | 3/2014 | Fukushima | |
| 2016/0369145 | A1 | 12/2016 | Fukushima et al. | |

FOREIGN PATENT DOCUMENTS

| | | | | | |
|---|---|---|---|---|---|
| JP | 2000130896 | A | * | 5/2000 | ..... B60H 1/3225 |
| JP | 2004-069295 | A | | 3/2004 | |
| JP | 2014-052481 | A | | 3/2014 | |
| JP | 2014-173753 | A | | 9/2014 | |
| WO | 2012/157764 | A1 | | 11/2012 | |
| WO | 2015/136979 | A1 | | 9/2015 | |
| WO | 2015/140876 | A1 | | 9/2015 | |
| WO | 2015/141676 | A1 | | 9/2015 | |

OTHER PUBLICATIONS

International Search Report dated Jun. 14, 2016 issued in corresponding international patent application No. PCT/JP2016/059862(with English translation).

Office Action dated Dec. 24, 2019 issued in corresponding CN patent application No. 201680083697.0 (and English translation).

Office Action dated May 9, 2020 issued in corresponding CN patent application No. 201680083697.0 (and English translation).

Examination Report dated Aug. 13, 2020 issued in corresponding IN patent application No. 201847033671 (and English translation).

* cited by examiner

OUTDOOR UNIT

CROSS REFERENCE TO RELATED APPLICATION

This application is a U.S. national stage application of International Application No. PCT/JP2016/059862, filed on Mar. 8, 2016, the contents of which are incorporated herein by reference.

TECHNICAL FIELD

The present invention relates to an outdoor unit for a refrigeration cycle apparatus using 1,1,2-trifluoroethylene.

BACKGROUND ART

In recent years, in view of preventing global warming, reduction of greenhouse effect gas has been demanded. Also with regard to refrigerant to be used in a refrigeration cycle apparatus such as an air-conditioning apparatus, refrigerant having a low global warming potential (GWP) is considered. A GWP of R410A that is now widely used as refrigerant for an air-conditioning apparatus is 2,088, which is a considerably large value. Difluoromethane (R32) having been increasingly employed in recent years has a GWP of 675, which is also a considerably large value.

Examples of the refrigerant having a low GWP include carbon dioxide (R744: GWP=1), ammonia (R717: GWP=0), propane (R290: GWP=6), 2,3,3,3-tetrafluoropropene (R1234yf: GWP=4), and 1,3,3,3-tetrafluoropropene (R1234ze: GWP=6).

Those low-GWP refrigerants have the following problems. Thus, there is difficulty in applying those low-GWP refrigerants to a general air-conditioning apparatus.

- R744: A working pressure is very high, and hence there is a problem in ensuring a pressure resistance. Moreover, a critical temperature is at a low temperature of 31 degrees Celsius, and hence there is a problem in ensuring performance for use in an air-conditioning apparatus.
- R717: It is highly toxic, and hence there is a problem in ensuring safety.
- R290: It is highly flammable, and hence there is a problem in ensuring safety.
- R1234yf and R1234ze: A volume flow rate is large at a low working pressure, and hence there is a problem of degradation in performance due to increase in pressure loss.

As refrigerant for overcoming the problems described above, there has been given 1,1,2-trifluoroethylene (HFO-1123) (for example, see Patent Literature 1). This refrigerant has, in particular, the following advantages.

- A working pressure is high, and a volume flow rate of the refrigerant is small. Thus, the pressure loss is small, and the performance can be easily ensured.
- A GWP is less than 1, and hence it has high superiority as a measure against the global warming.

PATENT LITERATURE

Patent Literature 1: WO 2012/157764 A1

NON-PATENT LITERATURE

Non-Patent Literature 1: Andrew E. Feiring, Jon D. Hulburt, "Trifluoroethylene deflagration", Chemical & Engineering News (22 Dec. 1997) Vol. 75, No. 51, pp. 6

The HFO-1123 has the following problem.

(1) In a high-temperature and high-pressure state, when ignition energy is imparted, explosion occurs (for example, see Non-Patent Literature 1).

Therefore, in order to apply the HFO-1123 to a refrigeration cycle apparatus, it is required to overcome the problem described above.

With regard to the problem described above, it has been found that explosion occurs due to a chain of disproportionation reactions. This phenomenon occurs under the following two conditions.

(1a) Ignition energy (high-temperature portion) is generated inside the refrigeration cycle apparatus (in particular, compressor), and the disproportionation reactions occur.

(1b) In a high-temperature and high-pressure state, the disproportionation reactions spread in a chain.

SUMMARY

The present invention has been made to overcome the problem described above, and has an object to provide an outdoor unit for a refrigeration cycle apparatus capable of ensuring safety even with use of HFO-1123.

According to one embodiment of the present invention, there is provided an outdoor unit for use in a refrigeration cycle apparatus circulating refrigerant mixture inclusive of 1,1,2-trifluoroethylene, the outdoor unit including: a casing; a pipe configured to allow the refrigerant mixture to flow through the pipe, the pipe being accommodated inside the casing and including a bend portion, the bend portion comprising a breakage-guide structure having a pressure resistance lower than a pressure resistance of rest of the pipe; and a plate interposed between the breakage-guide structure and outside of the casing.

With the configuration of the refrigeration cycle apparatus using the outdoor unit according to the embodiment of the present invention, when the pressure of the refrigerant mixture abnormally increases, the pipe is broken at the breakage-guide structure portion, and hence the refrigerant mixture can be discharged to outside of the pipe. Therefore, disproportionation reactions of the 1,1,2-trifluoroethylene (HFO-1123) can be prevented from spreading as a chain reaction, thereby being capable of preventing explosion caused by the disproportionation reactions.

Moreover, the outdoor unit according to the embodiment of the present invention includes the breakage-guide structure at the bend portion. Therefore, the breakage-guide structure can be broken in a small scale under a state in which few or no scattered object is present. Further, the outdoor unit according to the embodiment of the present invention includes the plate interposed between the breakage-guide structure and the outside of the casing. Therefore, the refrigerant mixture having been blown out from the breakage part can be prevented from jetting out to the outside of the outdoor unit.

Thus, with the configuration of the refrigeration cycle apparatus using the outdoor unit according to the embodiment of the present invention, the refrigeration cycle apparatus capable of ensuring the safety even with use of the HFO-1123 can be provided.

DETAILED DESCRIPTION

Embodiment 1

Figure 1:
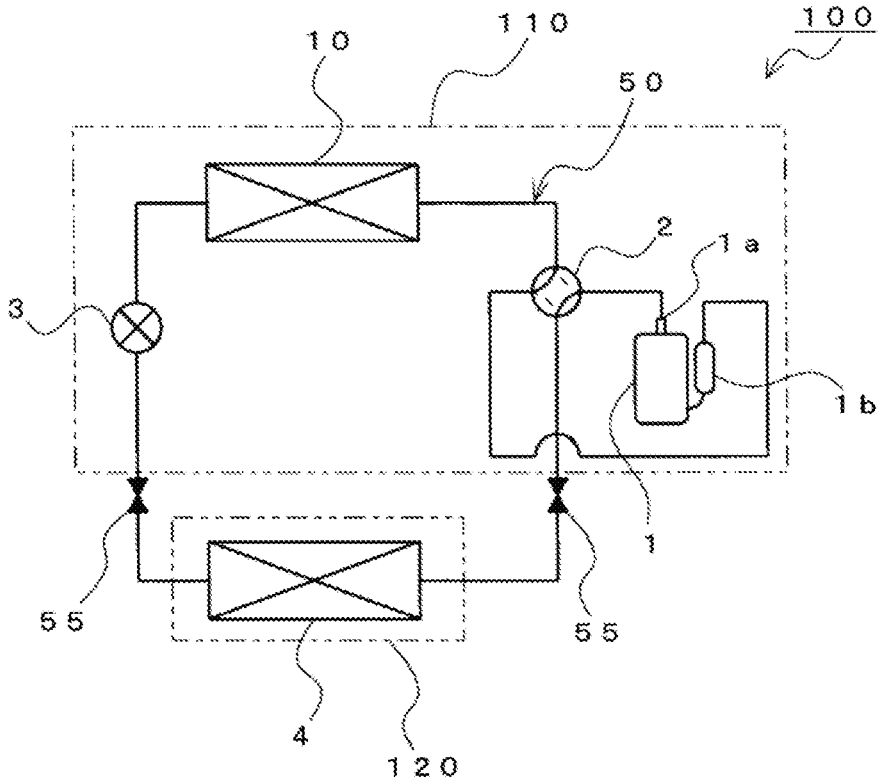
FIG. 1 is a circuit diagram of a refrigeration cycle apparatus including an outdoor unit according to Embodiment 1 of the present invention.

FIG. 1 is a circuit diagram of a refrigeration cycle apparatus including an outdoor unit according to Embodiment 1 of the present invention.

In Embodiment 1, a refrigeration cycle apparatus 100 is an air-conditioning apparatus. Even when the refrigeration cycle apparatus 100 is an apparatus other than the air-conditioning apparatus (for example, heat pump cycle apparatus), an outdoor unit 110 according to Embodiment 1 can be applied.

The refrigeration cycle apparatus 100 includes a refrigerant circuit 50 circulating refrigerant. The refrigerant circuit 50 includes a compressor 1, a flow switching device 2, an outdoor heat exchanger 10, an expansion valve 3, and an indoor heat exchanger 4, which are connected by refrigerant pipes.

The compressor 1 is configured to compress low-pressure gas refrigerant having been sucked through a suction port and discharge the compressed high-pressure gas refrigerant through a discharge port 1*a*. In the compressor 1 in Embodiment 1, a suction muffler 1*b* configured to separate liquid refrigerant and gas refrigerant is provided at the suction port. The flow switching device 2 is, for example, a four-way valve, and is connected to the discharge port 1*a* of the compressor 1 by the refrigerant pipe. The flow switching device 2 is configured to switch the flow path of the refrigerant. By the switching, the high-pressure gas refrigerant discharged from the compressor 1 flows either to the outdoor heat exchanger 10 or to the indoor heat exchanger 4.

The outdoor heat exchanger 10 operates as a condenser during cooling, and is configured to reject heat from refrigerant compressed by the compressor 1. Moreover, the outdoor heat exchanger 10 operates as an evaporator during heating, and is configured to exchange heat between outdoor air and refrigerant expanded in the expansion valve 3 to heat the refrigerant. The outdoor heat exchanger 10 in Embodiment 1 is, for example, a fin-and-tube heat exchanger, and has the following configuration.

Figure 2:
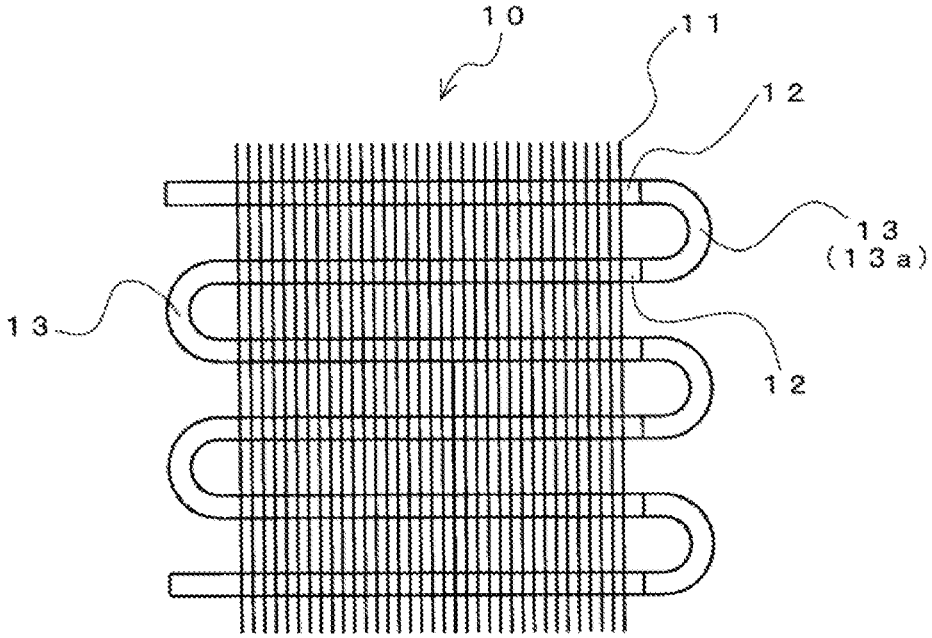
FIG. 2 is a side view for illustrating an outdoor heat exchanger in Embodiment 1 of the present invention.

FIG. 2 is a side view for illustrating the outdoor heat exchanger in Embodiment 1 of the present invention.

The outdoor heat exchanger 10 includes a plurality of fins 11 stacked at preset intervals and a plurality of heat transfer tubes 12 stacked at preset intervals so as to penetrate through the fins 11. Moreover, the outdoor heat exchanger 10 includes bend portions 13 each connecting two heat transfer tubes 12. For example, the bend portion 13 is formed integrally with two heat transfer tubes 12 by bending one pipe into a hair-pin shape. Moreover, for example, the bend portion 13 may be a U-bent 13*a* formed separately from the heat transfer tubes 12. The U-bent 13*a* is connected to the two heat transfer tubes 12 by brazing.

Referring back to FIG. 1, the expansion valve 3 is configured to expand refrigerant having rejected heat in the condenser, that is, refrigerant flowing into the expansion valve 3. The indoor heat exchanger 4 operates as a condenser during heating, and is configured to cause the refrigerant compressed by the compressor 1 to reject heat. Moreover, the indoor heat exchanger 4 operates as an evaporator during cooling, and is configured to exchange heat between indoor air and the refrigerant having been expanded in the expansion valve 3 to heat the refrigerant. The indoor heat exchanger 4 is, for example, a fin-and-tube heat exchanger. When the refrigeration cycle apparatus 100 is configured to perform only one of cooling and heating, the flow switching device 2 is not required.

In Embodiment 1, as refrigerant which circulates in the refrigerant circuit 50, there is used a refrigerant mixture inclusive of 1,1,2-trifluoroethylene (HFO-1123) and a refrigerant different from the HFO-1123.

As preferred refrigerant, refrigerant mixture inclusive of HFO-1123 and difluoromethane (R32) may be used. As the other refrigerant, 2,3,3,3-tetrafluoropropene (R1234yf), trans-1,3,3,3-tetrafluoropropene (R1234ze(E)), cis-1,3,3,3-tetrafluoropropene (R1234ze(Z)), 1,1,1,2-tetrafluoroethane (R134a), or 1,1,1,2,2-pentafluoroethane (R125) may be used in addition to R32. Moreover, at least two of those refrigerants may be employed as the other refrigerant to be mixed with the HFO-1123.

The above-mentioned components of the refrigerant circuit 50 are accommodated inside the outdoor unit 110 or an indoor unit 120. Specifically, the indoor heat exchanger 4 is accommodated inside the indoor unit 120. Moreover, the compressor 1, the flow switching device 2, the outdoor heat exchanger 10, and the refrigerant pipes connecting those components are accommodated inside the outdoor unit 110. That is, the refrigerant pipes connecting those components each correspond to "the pipe accommodated inside the casing of the outdoor unit" in the present invention. Moreover, the heat transfer tubes 12, the bend portions 13, and the U-bents 13*a*, which form the outdoor heat exchanger 10, each also correspond to "the pipe accommodated inside the casing of the outdoor unit" in the present invention. The expansion valve 3 is accommodated inside the outdoor unit 110 or the indoor unit 120. In FIG. 1, illustration is given of an example in which the expansion valve 3 is accommodated inside the outdoor unit 110.

Moreover, the outdoor unit 110 and the indoor unit 120 are connectable to and separable from the refrigerant circuit by valves 55 provided in the refrigerant circuit 50. That is, the outdoor unit 110 and the indoor unit 120 are connectable to each other by the valves 55 after the outdoor unit 110 and the indoor unit 120 are installed at respective installation positions. For example, under a state in which the refrigerant mixture is sealed in the outdoor unit 110, and the valves 55 are closed, the outdoor unit 110 is installed at its installation position. Moreover, the indoor unit 120 is installed at its installation position. After that, the outdoor unit 110 and the indoor unit 120 are connected to the valves 55, and the valves 55 are opened. With this, the refrigerant mixture can circulate in the refrigerant circuit 50, and the refrigeration cycle apparatus 100 can be used.

Figure 3:
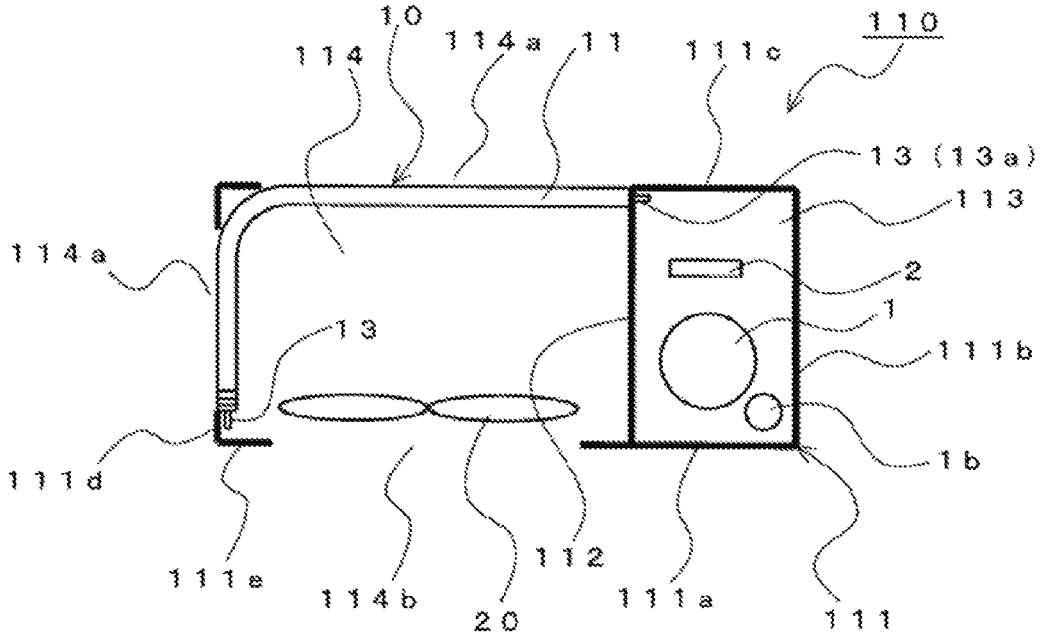
FIG. 3 is a sectional view for illustrating the outdoor unit according to Embodiment 1 of the present invention as seen from above.

FIG. 3 is a sectional view for illustrating the outdoor unit according to Embodiment 1 of the present invention as seen from above.

Now, with reference to FIG. 3, description is made of specific arrangement of the components accommodated inside the outdoor unit 110.

The outdoor unit 110 includes a casing 111 having a substantially parallelepiped shape and being formed of plates such as copper plates. The inside of the casing 111 is partitioned into a machine chamber 113 and an air-sending chamber 114 by a partition plate 112 being a plate such as a copper plate. In other words, the casing 111 includes the machine chamber 113 and the air-sending chamber 114. Moreover, the air-sending chamber 114 has air inlets 114*a* formed in a back surface portion and a left side panel, and an air outlet 114*b* formed in a front surface portion.

The outdoor heat exchanger 10 is accommodated inside the air-sending chamber 114 so that the fins 11 are opposed to the air inlets 114*a*. Moreover, an air-sending device 20 being, for example, a propeller fan is provided in the air-sending chamber 114 so as to be opposed to the air outlet 114*b*. That is, when the air-sending device 20 is driven, outdoor air is sucked into the air-sending chamber 114 through the air inlets 114*a* and then is blown out through the air outlet 114*b*. The air sucked into the air-sending chamber 114 exchanges heat with refrigerant mixture flowing through the outdoor heat exchanger 10 when the air passes through the outdoor heat exchanger 10.

The bend portions 13 of the outdoor heat exchanger 10 are arranged at positions not being opposed to the air inlets 114*a*. Specifically, as illustrated in FIG. 2, the bend portions 13 are formed at both end portions of the outdoor heat exchanger 10. The bend portions 13 formed at one end portion are arranged on a front side with respect to the air inlet 114*a* formed in the left side panel of the air-sending chamber 114. That is, in the outdoor unit 110 according to Embodiment 1, a plate 111*d*, which forms a portion in the front part of the left side panel of the air-sending chamber 114, and a plate 111*e*, which forms a portion in the left part of the front surface portion of the air-sending chamber 114, are interposed between the bend portions 13 and the outside of the casing 111 of the outdoor unit 110. Moreover, the bend portions 13 formed at another end portion are accommodated inside the machine chamber 113. That is, in the outdoor unit 110 according to Embodiment 1, plates 111*a*, 111*b*, and 111*c* and the partition plate 112 forming the machine chamber 113 are interposed between the bend portions 13 and the outside of the casing 111 of the outdoor unit 110. In Embodiment 1, the bend portions 13 formed on the side accommodated inside the machine chamber 113 are the U-bents 13*a*.

Moreover, for example, the compressor 1 and the flow switching device 2 are also accommodated inside the machine chamber 113.

When the refrigeration cycle apparatus 100 having the above-mentioned configuration is operated, the refrigerant mixture circulating in the refrigerant circuit 50 has a in a part of the refrigerant circuit from the discharge port 1*a* of the compressor 1 to an inflow port of the expansion valve 3. This part of the refrigerant circuit 50 may be referred to as a high-pressure side. The refrigerant mixture has a low-pressure side in a part of the refrigerant circuit from an outflow port of the expansion valve 3 to the suction port of the compressor 1. This part of the refrigerant circuit 50 may be referred to as a low-pressure side. In Embodiment 1, a ratio of the HFO-1123 in the refrigerant mixture is equal to or more than 1 wt % and equal to or less than 35 wt %. In the case of using such refrigerant mixture, the pressure of the refrigerant mixture on the high-pressure side in the refrigerant circuit 50 is approximately equal to or less than 4 MPa regardless of a kind of another refrigerant different from the HFO-1123.

When the refrigeration cycle apparatus 100 is brought into, for example, the following states, the pressure of the refrigerant mixture on the high-pressure side in the refrigerant circuit 50 may abnormally increase.

(1) Under a state in which the outdoor heat exchanger 10 operates as a condenser, when the air-sending device 20 stops, the high-temperature and high-pressure gas refrigerant flowing through the outdoor heat exchanger 10 cannot be condensed. As a result, the pressure of the refrigerant mixture on the high-pressure side in the refrigerant circuit 50 abnormally increases.

(2) Under a state in which the outdoor heat exchanger 10 operates as a condenser, when an object is placed in the vicinity of the air inlets 114*a* or the air outlet 114*b* of the outdoor unit 110, the amount of outdoor air passing through the air-sending chamber 114 is reduced, and the high-temperature and high-pressure gas refrigerant flowing through the outdoor heat exchanger 10 cannot be condensed. As a result, the pressure of the refrigerant mixture on the high-pressure side in the refrigerant circuit 50 abnormally increases.

(3) As a result of starting the operation of the refrigeration cycle apparatus 100 under a state in which the valve 55 is left unopened, the pressure of the refrigerant mixture on the high-pressure side in the refrigerant circuit 50 abnormally increases.

(4) The inside of the refrigerant circuit 50 is clogged due to, for example, aging degradation. As a result, the pressure of the refrigerant mixture on the high-pressure side in the refrigerant circuit 50 abnormally increases.

Moreover, as mentioned above, in the high-temperature and high-pressure state, disproportionation reactions of the HFO-1123 included in the refrigerant mixture spread in a chain. Therefore, for example, when the HFO-1123 catches fire from an ignition source in the compressor 1 (for example, motor or wires supplying power to the motor), the disproportionation reactions of the HFO-1123 spread as a chain reaction, and there is a fear in that explosion is caused by the disproportionation reactions.

Therefore, in the outdoor unit 110 according to Embodiment 1, the bend portions 13 of the outdoor heat exchanger 10 each include a breakage-guide structure 30 having a pressure resistance lower than a pressure resistance of rest of the pipes forming the refrigerant circuit 50. Specifically, the breakage-guide structure 30 in Embodiment 1 has the following configuration. Now, description is made of an example in which the U-bent 13*a* includes the breakage-guide structure 30.

Figure 4:
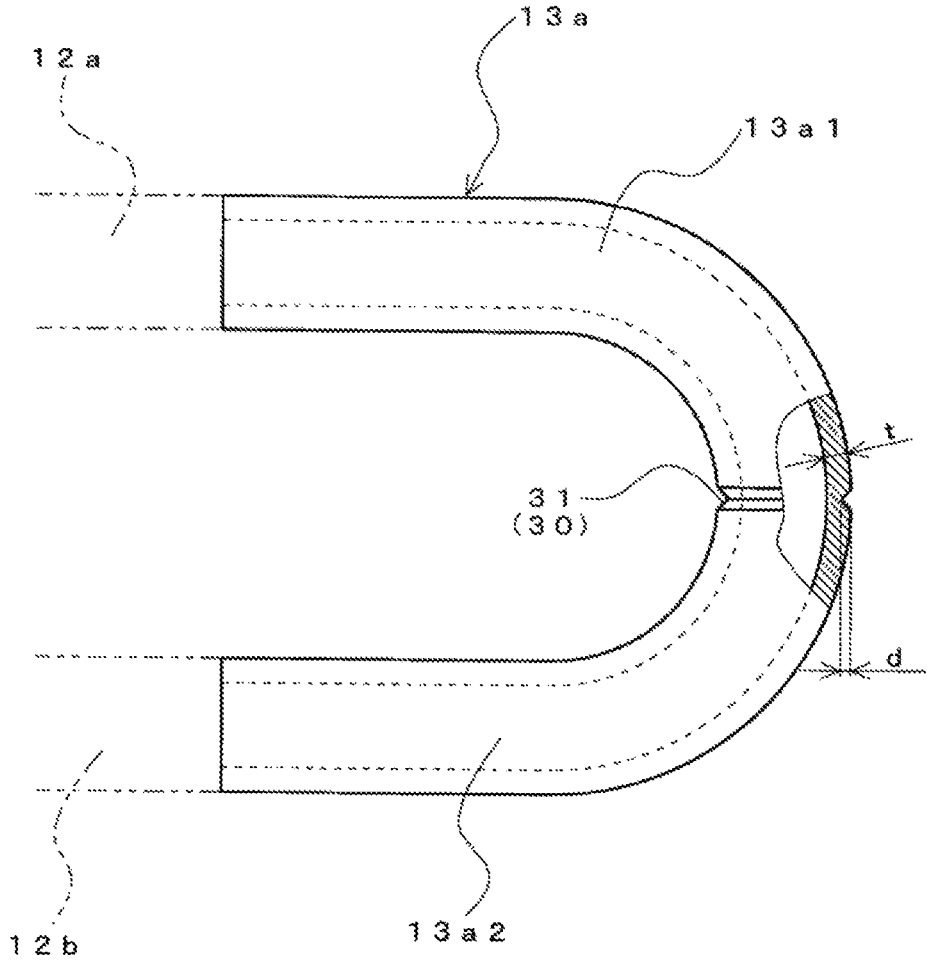
FIG. 4 is a side view for illustrating a U-bent in Embodiment 1 of the present invention.

FIG. 4 is a side view illustrating the U-bent in Embodiment 1 of the present invention. In FIG. 4, a cross section is partially illustrated.

As illustrated in FIG. 4, the breakage-guide structure 30 in Embodiment 1 has a notch structure having a notch 31. The notch 31 is formed in an outer periphery of the pipe, for example, so as to extend along an entire periphery. With this, when the pressure of the refrigerant mixture on the high-pressure side in the refrigerant circuit 50 abnormally increases, the breakage-guide structure 30 is broken. Thus, the refrigerant mixture can be discharged to the outside of the pipe, thereby being capable of releasing the pressure in the refrigerant circuit 50. Therefore, the disproportionation reactions of the HFO-1123 can be prevented from spreading as a chain reaction, thereby being capable of preventing explosion caused by the disproportionation reactions.

Moreover, in Embodiment 1, the U-bent 13*a* being the bend portion 13 is to be broken. Thus, the breakage in a small scale can be achieved, thereby being capable of attaining a state in which few or no scattered object is present. Prior to detailed description of the effect, the U-bent 13*a* is observed in the state illustrated in FIG. 4. That is, for convenience, the heat transfer tube 12 connected to an upper end portion of the U-bent 13*a* is referred to as a heat transfer tube 12*a*. The heat transfer tube 12 connected to a lower end portion of the U-bent 13*a* is referred to as a heat transfer tube 12*b*. A portion of the U-bent 13*a* which is located on an upper side relative to the notch 31 is referred to as an upper portion 13*a*1. A portion of the U-bent 13*a* which is located on a lower side with respect to the notch 31 is referred to as a lower portion 13*a*2.

When the breakage guide structure breaks at the notch 31, the force of the refrigerant mixture blowing out from the notch 31 causes a force of pushing upward to act on the upper portion 13*a*1 of the U-bent 13*a*. This force also acts on the heat transfer tube 12*a* connected to the upper portion 13*a*1. However, a reaction force of the heat transfer tube 12*a* being a linear pipe causes the upper portion 13*a*1 to be pushed downward. Similarly, when breakage is induced at the notch 31, the force of the refrigerant mixture blowing out from the notch 31 causes a force of pushing downward to act on the lower portion 13*a*2 of the U-bent 13*a*. This force also acts on the heat transfer tube 12*b* connected to the lower portion 13*a*2. However, a reaction force of the heat transfer tube 12*b* being a linear pipe causes the lower portion 13*a*2 to be pushed upward. Therefore, when the notch 31 is broken, movement of the upper portion 13*a*1 and the lower portion 13*a*2 of the U-bent 13*a* is reduced, thereby being capable of reducing the breakage of the U-bent 13*a*. Moreover, through the reduction in movement of the upper portion 13*a*1 and the lower portion 13*a*2 of the U-bent 13*a*, interference of the upper portion 13*a*1 and the lower portion 13*a*2 with nearby components can be suppressed, thereby being capable of attaining the state in which few or no scattered object is present.

Further, in Embodiment 1, the U-bents 13*a* are accommodated inside the machine chamber 113. That is, the plates 111*a*, 111*b*, and 111*c* and the partition plate 112 forming the machine chamber 113 are interposed between the U-bents 13*a* each having the notch 31 and the outside of the casing 111 of the outdoor unit 110. Therefore, the refrigerant mixture having been blown out from the notch 31 being the breakage part can be prevented from jetting out to the outside of the outdoor unit 110.

Thus, with the refrigeration cycle apparatus 100 using the outdoor unit 110 according to Embodiment 1, the refrigeration cycle apparatus 100 capable of ensuring safety even with use of the HFO-1123 can be provided.

It is preferred that the notch 31 does not penetrate through the U-bent 13*a* and have a depth equal to or more than 30% of a thickness at a part of the U-bent 13*a* at which the notch 31 is not formed. In other words, it is preferred that $0.3t \leq d < t$ be satisfied when the thickness at the part of the U-bent 13*a* at which the notch 31 is not formed is "t", and the depth of the notch 31 is "d". Through setting of the depth of the notch 31 in such a manner, the difference in pressure resistance is clarified, thereby being capable of more reliably and promptly breaking the breakage-guide structure 30 as compared to rest of the pipe.

Moreover, when the ratio of the HFO-1123 to the refrigerant mixture is equal to or less than 35 wt % as in Embodiment 1, it is preferred that the breakage-guide structure 30 breaks at a pressure of from 10 MPa to 15 MPa. Specifically, resin which covers a winding of a motor of the compressor 1 and a wire for supplying power to the motor typically has a heat resistance of from about 230 degrees Celsius to about 250 degrees Celsius. Therefore, a temperature at which the resin is melted to expose the winding or the wire is assumed to be about 300 degrees Celsius. In view of this, the inventors of the present invention conducted studies to find out a degree of pressure which causes the disproportionation reactions of the HFO-1123 to spread as a chain reaction when the refrigerant mixture inclusive of the HFO-1123 at a ratio of equal to or less than 35 wt % is used under an environment of 300 degrees Celsius. As a result of the studies, it was found that, when the pressure is higher than 15 MPa, the disproportionation reactions of the HFO-1123 spread as a chain reaction. Moreover, it was also found that, when the pressure of the refrigerant mixture on the high-pressure side in the refrigerant circuit 50 abnormally increases as mentioned above, the pressure on the high-pressure side may increase to the pressure around 10 MPa. Thus, when the ratio of the HFO-1123 in the refrigerant mixture is equal to or less than 35 wt % as in Embodiment 1, it is preferred that the breakage-guide structure 30 be broken at the pressure of from 10 MPa to 15 MPa.

Moreover, in Embodiment 1, the notch 31 being the breakage-guide structure 30 is formed in each of the bend portions 13 accommodated inside the machine chamber 113 among the bend portions 13 of the outdoor heat exchanger 10. However, the present invention is not limited to this configuration. The notch 31 may be formed in each of the bend portions 13 arranged in the air-sending chamber 114. Between the bend portions 13 and the outside of the casing 111 of the outdoor unit 110, as mentioned above, the plate 111*d* forming the portion in the front part of the left side panel of the air-sending chamber 114 and the plate 111*e* forming the portion in the left part of the front surface portion of the air-sending chamber 114 are interposed. Therefore, even when the notch 31 is formed in each of the bend portions 13 accommodated inside the machine chamber 113, the refrigerant mixture having been blown out from the notch 31 can be prevented from jetting out to the outside of the outdoor unit 110. However, the air-sending chamber 114 has large opening portions such as the air inlets 114*a* and the air outlet 114*b*. Meanwhile, the machine chamber 113 does not have such a large opening portion. Therefore, when the notch 31 is formed in each of the bend portions 13 accommodated inside the machine chamber 113, the refrigerant mixture having been blown out from the notch 31 can be more reliably prevented from jetting out to the outside of the outdoor unit 110.

Embodiment 2

In Embodiment 1, the notch structure is employed as the breakage-guide structure 30. However, the structure of the breakage-guide structure 30 is not limited to the notch structure. For example, the following structure may be employed. In Embodiment 2, items which are not particularly mentioned are the same as those of Embodiment 1, and the same functions or components are described with the same reference symbols.

Figure 5:
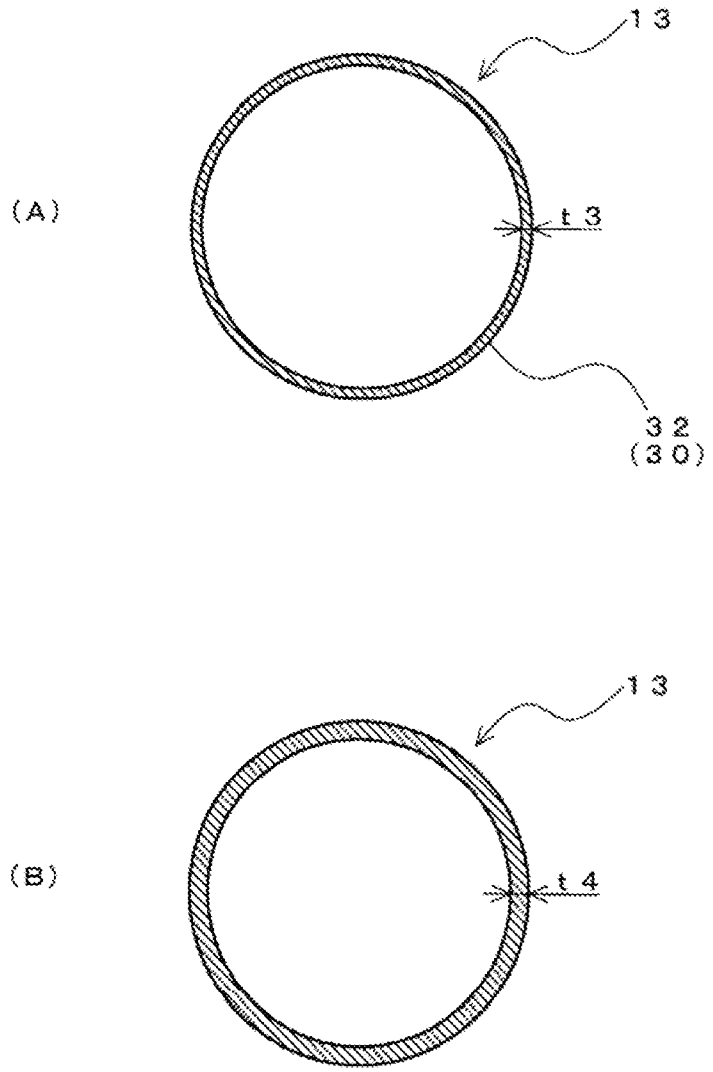
FIG. 5 are sectional views for illustrating a bend portion of an outdoor heat exchanger in Embodiment 2 of the present invention.

FIG. 5 are sectional views for illustrating a bend portion of an outdoor heat exchanger in Embodiment 2 of the present invention. FIG. 5(A) is an illustration of a cross section of a small-thickness portion 32 described later. FIG.

5(B) is an illustration of a cross section of the bend portion 13 at a part other than the small-thickness portion 32.

At a part of the bend portion 13 of the outdoor heat exchanger 10 in Embodiment 2, the small-thickness portion 32 having a thickness smaller than a thickness of the bend portion 13 at another part is formed. In Embodiment 2, the small-thickness portion 32 is provided as the breakage-guide structure 30. In other words, the breakage-guide structure 30 in Embodiment 2 has a small-thickness structure.

A pressure resistance of the small-thickness portion 32 is lower than a pressure resistance of the bend portion 13 at a part other than the small-thickness portion 32. Thus, when the pressure of the refrigerant mixture on the high-pressure side in the refrigerant circuit 50 abnormally increases, the small-thickness portion 32 is broken. Thus, the refrigerant mixture can be discharged to the outside of the pipe, thereby being capable of releasing the pressure in the refrigerant circuit 50. Therefore, even when the small-thickness portion 32 is employed as the breakage-guide structure 30, the disproportionation reactions of the HFO-1123 can be prevented from spreading as a chain reaction, thereby being capable of preventing explosion caused by the disproportionation reactions.

It is preferred that a thickness reduction ratio of the small-thickness portion 32 be equal to or less than 70%. When a thickness of the small-thickness portion 32 is t3, and a thickness of the bend portion 13 at a part other than the small-thickness portion 32 is t4, the thickness reduction ratio is defined by t3/t4. That is, it is preferred that the small-thickness portion 32 have a thickness reduction ratio of $t3/t4 \leq 0.7$. Through setting of the thickness reduction ratio of the small-thickness portion 32 as described above, the difference in pressure resistance is clarified, thereby being capable of more reliably and promptly breaking the breakage-guide structure 30 as compared to rest of the pipe. A lower limit value of the thickness reduction ratio of the small-thickness portion 32 may suitably be determined in accordance with a lower limit value of the pressure at which the breakage-guide structure 30 is broken.

In Embodiment 2, in sectional view of the bend portion 13, the thickness of the pipe is reduced over an entire periphery of the pipe to form the small-thickness portion 32 over an entire periphery of the pipe. However, the present invention is not limited to this configuration. In sectional view of the bend portion 13, the thickness may be reduced at a part of the entire periphery, and that portion may be the small-thickness portion 32.

Moreover, as a matter of course, the structure of the breakage-guide structure 30 described in Embodiment 2 and the structure of the breakage-guide structure 30 described in Embodiment 1 may be combined with each other. That is, the notch 31 may be formed in the small-thickness portion 32 to provide the breakage-guide structure 30. With the configuration in which the structures described in Embodiments 1 and 2 are combined with each other to provide the breakage-guide structure 30, the breakage-guide structure 30 can be broken at a pressure close to a target value, thereby being capable of reducing a range of the pressure at which the breakage-guide structure 30 is broken. That is, the operation of the refrigeration cycle apparatus 100 can be more stabilized.

Embodiment 3

The structure of the breakage-guide structure 30 is not limited to the structures in Embodiments 1 and 2. For example, the following structure may be employed. In Embodiment 3, items which are not particularly mentioned are the same as those of Embodiment 1, and the same functions or components are described with the same reference symbols.

Figure 6:
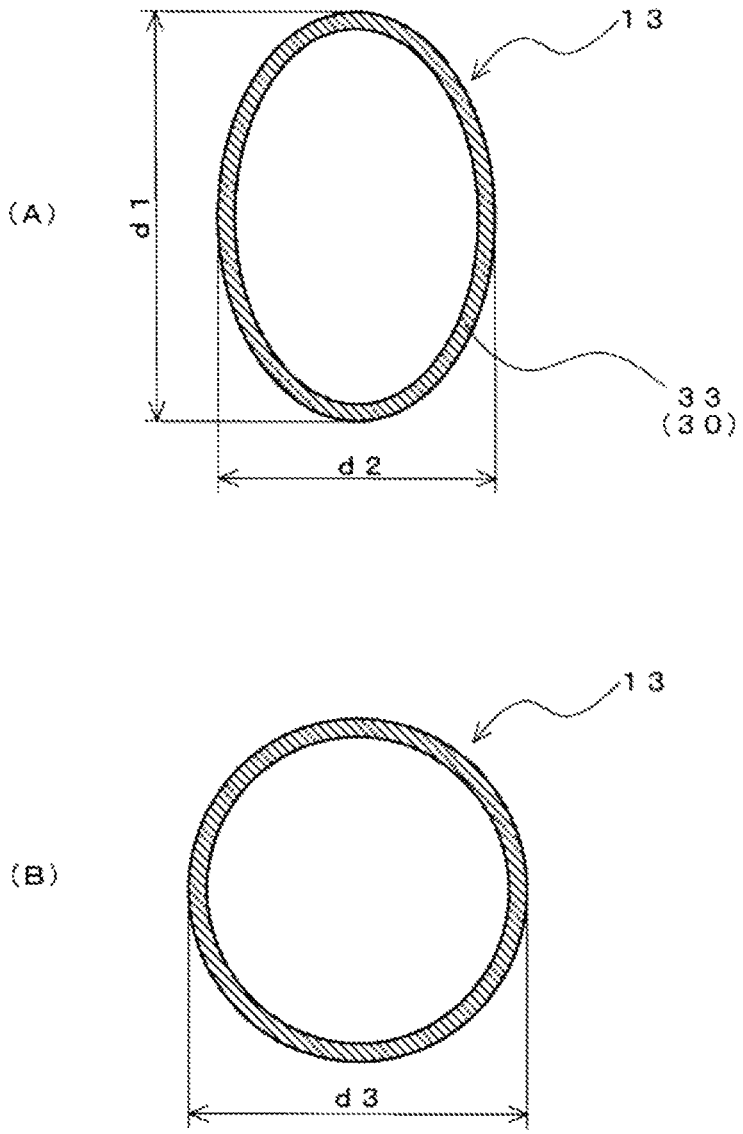
FIG. 6 are sectional views for illustrating a bend portion of an outdoor heat exchanger in Embodiment 3 of the present invention.

FIG. 6 are sectional views for illustrating a bend portion of an outdoor heat exchanger in Embodiment 3 of the present invention. FIG. 6(A) is an illustration of a cross section of an elliptical portion 33 described later. FIG. 6(B) is an illustration of a cross section of the bend portion 13 at a part other than the elliptical portion 33.

A part of the bend portion 13 of the outdoor heat exchanger 10 in Embodiment 3 is the elliptical portion 33 having a substantially elliptical sectional shape in an outer peripheral portion. Moreover, the bend portion 13 is formed into a circular pipe shape at a part other than the elliptical portion 33, and has a circular sectional shape in an outer peripheral portion. In Embodiment 3, the elliptical portion 33 is provided as the breakage-guide structure 30. In other words, the breakage-guide structure 30 in Embodiment 3 has a flattened structure.

A pressure resistance of the elliptical portion 33 is lower than a pressure resistance of the circular pipe portion being the bend portion 13 at a part other than the elliptical portion 33. Thus, when the pressure of the refrigerant mixture on the high-pressure side in the refrigerant circuit 50 abnormally increases, the elliptical portion 33 is broken. Thus, the refrigerant mixture can be discharged to the outside of the pipe, thereby being capable of releasing the pressure in the refrigerant circuit 50. Therefore, even when the elliptical portion 33 is employed as the breakage-guide structure 30, the disproportionation reactions of the HFO-1123 can be prevented from spreading as a chain reaction, thereby being capable of preventing explosion caused by the disproportionation reactions.

It is preferred that the flatness of the elliptical portion 33 be equal to or more than 10%. When a length of a major axis in a cross section of the outer peripheral portion of the elliptical portion 33 is d1, a length of a minor axis in the cross section of the outer peripheral portion of the elliptical portion 33 is d2, and a diameter of the cross section of the outer peripheral portion of the bend portion 13 at a part other than the elliptical portion 33 is d3, the flatness is defined by $(d1-d2)/d3$. That is, it is preferred that the elliptical portion 33 satisfy $(d1-d2)/d3 \geq 0.1$. Through setting of the flatness of the elliptical portion 33 in such a manner, the difference in pressure resistance is clarified, thereby being capable of more reliably and promptly breaking the breakage-guide structure 30 as compared to rest of the pipe. An upper limit value of the flatness of the elliptical portion 33 may suitably be determined in accordance with a lower limit value of the pressure at which the breakage-guide structure 30 is broken.

The bend portion 13 may entirely be formed of the elliptical portion 33. The pressure resistance of the bend portion 13 is lower than the pressure resistance of rest of the pipes forming the refrigerant circuit 50. Thus, when the pressure of the refrigerant mixture on the high-pressure side in the refrigerant circuit 50 abnormally increases, the bend portion 13 being the elliptical portion 33 is broken. Thus, the refrigerant mixture can be discharged to the outside of the pipe, thereby being capable of releasing the pressure in the refrigerant circuit 50. Therefore, even when the bend portion 13 is entirely formed of the elliptical portion 33, the disproportionation reactions of the HFO-1123 can be prevented from spreading as a chain reaction, thereby being capable of preventing explosion caused by the disproportionation reactions. Even when the bend portion 13 is entirely formed of the elliptical portion 33, it is preferred that the flatness be equal to or more than 10%. Through approximation to d3=(d1+d2)/2, the flatness can be defined by (d1−d2)/{(d1+d2)/2}.

Moreover, as a matter of course, the structure of the breakage-guide structure 30 described in Embodiment 3 and the structure of the breakage-guide structure 30 described in Embodiments 1 and 2 may be combined with each other. For example, at least one of the small-thickness portion 32 and the notch 31 may be formed in the elliptical portion 33 to provide the breakage-guide structure 30. With the configuration in which the structures described in Embodiments 1 to 3 are combined with each other to provide the breakage-guide structure 30, the breakage-guide structure 30 can be broken at a pressure close to a target value, thereby being capable of reducing a range of the pressure at which the breakage-guide structure 30 is broken. That is, the operation of the refrigeration cycle apparatus 100 can be more stabilized.

Embodiment 4

The structure of the breakage-guide structure 30 is not limited to the structures in Embodiment 1 to Embodiment 3. For example, the following structure may be employed. In Embodiment 4, items which are not particularly mentioned are the same as those of Embodiment 1, and the same functions or components are described with the same reference symbols.

The bend portion 13 of the outdoor heat exchanger 10 in Embodiment 4 is made of metal. The bend portion 13 of the outdoor heat exchanger 10 in Embodiment 4 partially has a coarse portion in which a particle size of crystal is larger than a particle size of crystal at another part of the bend portion. Through heating of a part of the bend portion 13, the particle size of crystal is increased as compare to another part. Thus, the coarse portion can be formed. In Embodiment 4, the coarse portion is provided as the breakage-guide structure 30. In other words, the breakage-guide structure 30 in Embodiment 4 has a coarse crystal structure.

A pressure resistance of the coarse portion is lower than a pressure resistance of the bend portion 13 at a part other than the coarse portion. Thus, when the pressure of the refrigerant mixture on the high-pressure side in the refrigerant circuit 50 abnormally increases, the coarse portion is broken. Thus, the refrigerant mixture can be discharged to the outside of the pipe, thereby being capable of releasing the pressure in the refrigerant circuit 50. Therefore, even when the coarse portion is employed as the breakage-guide structure 30, the disproportionation reactions of the HFO-1123 can be prevented from spreading as a chain reaction, thereby being capable of preventing explosion caused by the disproportionation reactions.

As a matter of course, the structure of the breakage-guide structure 30 described in Embodiment 4 and the structure of the breakage-guide structure 30 described in Embodiment 1 to Embodiment 3 may be combined with each other. For example, at least one of the elliptical portion 33, the small-thickness portion 32, and the notch 31 may be formed in the coarse portion to provide the breakage-guide structure 30. With the configuration in which the structures described in Embodiment 1 to Embodiment 4 are combined with each other to provide the breakage-guide structure 30, the breakage-guide structure 30 can be broken at a pressure close to a target value, thereby being capable of reducing a range of the pressure at which the breakage-guide structure 30 is broken. That is, the operation of the refrigeration cycle apparatus 100 can be more stabilized.

Embodiment 5

When the breakage-guide structure 30 is provided to the U-bent 13*a*, for example, the following structure may be employed. In Embodiment 5, items which are not particularly mentioned are the same as those of Embodiment 1, and the same functions or components are described with the same reference symbols.

Figure 7:
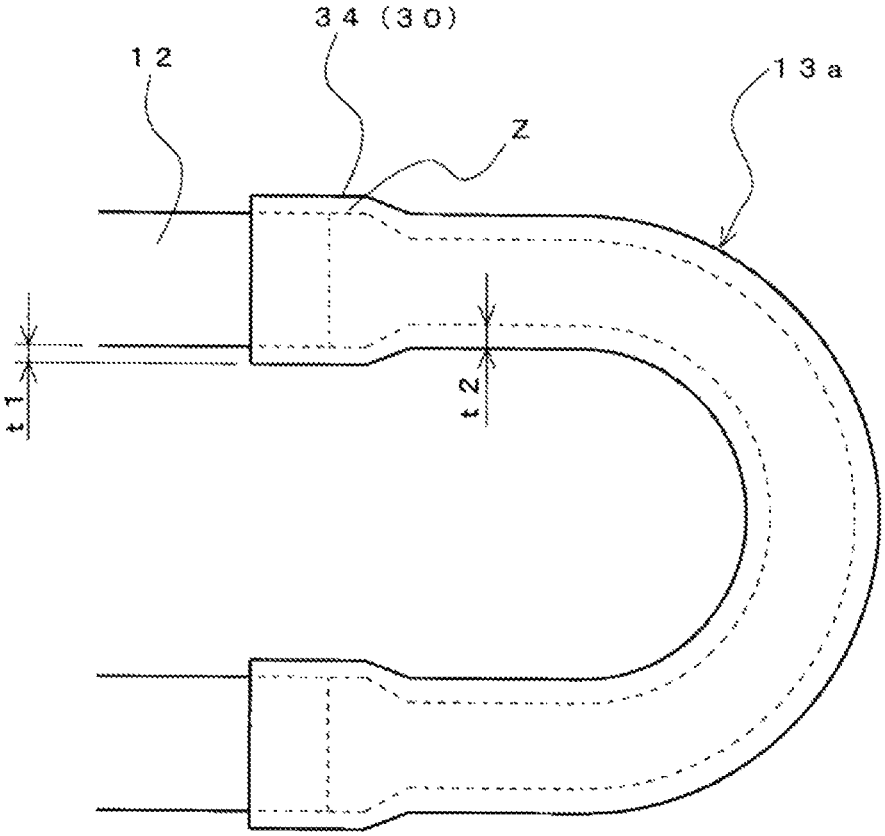
FIG. 7 is a side view for illustrating a U-bent in Embodiment 5 of the present invention.

FIG. 7 is a side view for illustrating a U-bent in Embodiment 5 of the present invention.

For example, at each of both end portions of the U-bent 13*a* in Embodiment 5, there is formed an expanded pipe portion 34 which is formed by widening the end portion. Under a state in which the heat transfer tube 12 is inserted into the expanded pipe portion 34, the heat transfer tube 12 and the expanded pipe portion 34 are joined to each other by brazing. With this, the heat transfer tube 12 and the U-bent 13*a* are connected to each other. In Embodiment 5, the expanded pipe portion 34 is provided as the breakage-guide structure 30.

When the expanded pipe portion 34 is formed by widening each of the both end portions of the U-bent 13*a*, a thickness of the expanded pipe portion 34 is smaller than a thickness of the bend portion 13 at a part other than the expanded pipe portion 34. Therefore, a pressure resistance of the expanded pipe portion 34 is lower than a pressure resistance of the bend portion 13 at a part other than the expanded pipe portion 34. Thus, when the pressure of the refrigerant mixture on the high-pressure side in the refrigerant circuit 50 abnormally increases, the expanded pipe portion 34 is broken. Thus, the refrigerant mixture can be discharged to the outside of the pipe, thereby being capable of releasing the pressure in the refrigerant circuit 50. Therefore, even when the expanded pipe portion 34 is provided as the breakage-guide structure 30, the disproportionation reactions of the HFO-1123 can be prevented from spreading as a chain reaction, thereby being capable of preventing explosion caused by the disproportionation reactions. Specifically, the heat transfer tube 12 is inserted into the end portion of the expanded pipe portion 34, and hence a double pipe structure is provided. Therefore, the expanded pipe portion 34 is broken at a root portion (portion Z in FIG. 7) of the expanded pipe portion 34 at which the double pipe structure is not provided.

It is preferred that a thickness reduction ratio of the expanded pipe portion 34 be equal to or less than 70%. When a thickness of the expanded pipe portion 34 is t1, and a thickness of the bend portion 13 at a part other than the expanded pipe portion 34 is t2, the thickness reduction ratio is defined by t1/t2. That is, it is preferred that the expanded pipe portion 34 satisfy $t1/t2 \leq 0.7$. Through setting of the thickness reduction ratio of the expanded pipe portion 34 as described above, the difference in pressure resistance is clarified, thereby being capable of more reliably and promptly breaking the breakage-guide structure 30 as compared to rest of the pipe. A lower limit value of the thickness reduction ratio of the expanded pipe portion 34 may suitably be determined in accordance with a lower limit value of the pressure at which the breakage-guide structure 30 is broken.

As a matter of course, the structure of the breakage-guide structure 30 described in Embodiment 5 and the structure of the breakage-guide structure 30 described in Embodiment 1 to Embodiment 4 may be combined with each other. For example, at least one of the coarse portion, the elliptical portion 33, the small-thickness portion 32, and the notch 31 may be formed in the expanded pipe portion 34 to provide the breakage-guide structure 30. With the configuration in which the structures described in Embodiment 1 to Embodiment 5 are combined with each other to provide the breakage-guide structure 30, the breakage-guide structure 30 can be broken at a pressure close to a target value, thereby being capable of reducing a range of the pressure at which the breakage-guide structure 30 is broken. That is, the operation of the refrigeration cycle apparatus 100 can be more stabilized.

Embodiment 6

The part at which the breakage-guide structure 30 in the present invention is provided is not limited to the bend portion 13 of the outdoor heat exchanger 10. For example, the breakage-guide structure 30 may be provided at the following parts. In Embodiment 6, items which are not particularly mentioned are the same as those of any one of Embodiment 1 to Embodiment 5, and the same functions or components are described with the same reference symbols.

Figure 8:
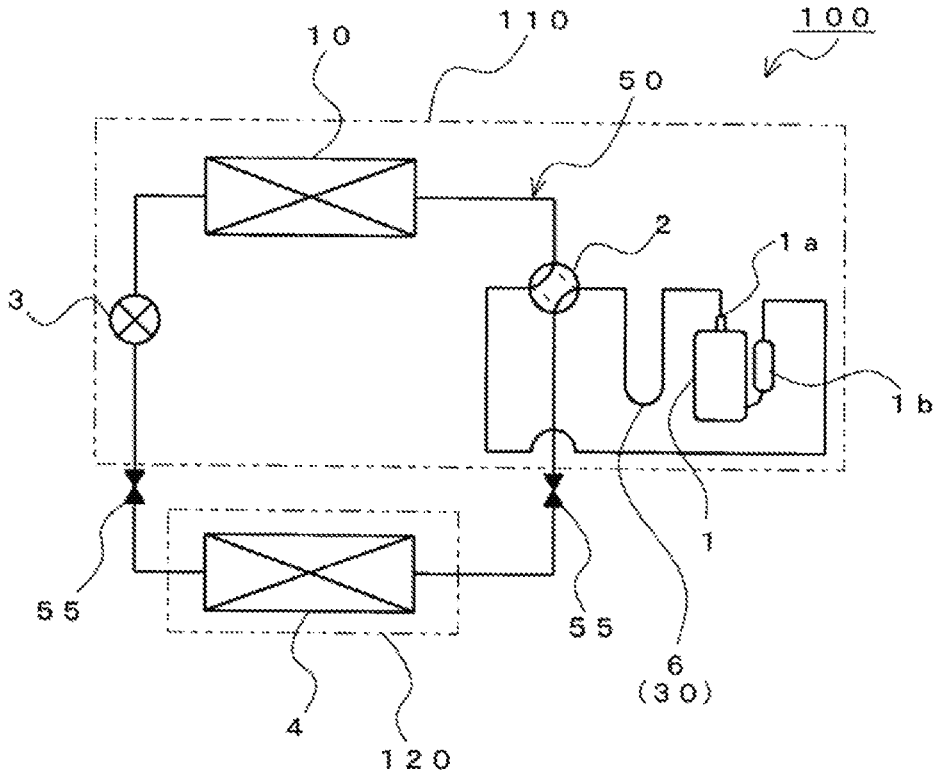
FIG. 8 is a circuit diagram of a refrigeration cycle apparatus including an outdoor unit according to Embodiment 6 of the present invention.

FIG. 8 is a circuit diagram of a refrigeration cycle apparatus including the outdoor unit according to Embodiment 6 of the present invention.

In the outdoor unit 110 according to Embodiment 6, a bend portion 6 is formed in a refrigerant pipe connecting the discharge port 1*a* of the compressor 1 and the flow switching device 2 to each other. That is, the bend portion 6 is formed between the discharge port 1*a* of the compressor 1 and the flow switching device 2. As mentioned above, the refrigerant pipe connecting the discharge port 1*a* of the compressor 1 and the flow switching device 2 to each other corresponds to "the pipe accommodated inside the casing of the outdoor unit" in the present invention. Moreover, as can be seen in FIG. 3, the compressor 1 and the flow switching device 2 are provided in the machine chamber 113. Thus, the bend portion 6 formed at a connection part between the compressor 1 and the flow switching device 2 is also formed in the machine chamber 113. That is, the plates 111*a*, 111*b*, and 111*c* and the partition plate 112 forming the machine chamber 113 are provided between the bend portion 6 and the outside of the casing 111 of the outdoor unit 110.

Thus, the bend portion 6 is formed similarly to the bend portion 13 of the outdoor heat exchanger 10 described in Embodiment 1 to Embodiment 5, and the breakage-guide structure 30 described in Embodiment 1 to Embodiment 5 is provided at the bend portion 6, thereby being capable of achieving the effect similar to those of Embodiment 1 to Embodiment 5.

In particular, the following effect can be achieved by providing the breakage-guide structure 30 to the bend portion 6 as in Embodiment 6. That is, when the refrigeration cycle apparatus 100 performs the heating operation, the outdoor heat exchanger 10 operates as an evaporator. Therefore, when the breakage-guide structure 30 is provided to the bend portion 13 of the outdoor heat exchanger 10 as in Embodiment 1 to Embodiment 5, during the heating operation, the breakage-guide structure 30 is arranged on the low-pressure side in the refrigerant circuit 50. Thus, during the heating operation, the breakage-guide structure 30 does not operate, that is, is not broken. Meanwhile, as in Embodiment 6, when the bend portion 6 is formed between the discharge port 1*a* of the compressor 1 and the flow switching device 2, and the breakage-guide structure 30 is provided to the bend portion 6, the breakage-guide structure 30 is arranged on the high-pressure side in the refrigerant circuit 50 in both during the heating operation and the cooling operation. Therefore, with the breakage-guide structure 30 provided as in Embodiment 6, the breakage-guide structure 30 can operate in both during the heating operation and the cooling operation.

The invention claimed is:

1. An outdoor unit in a refrigeration cycle apparatus circulating refrigerant mixture inclusive of 1,1,2-trifluoroethylene, the outdoor unit comprising:

a casing;

a pipe configured to allow the refrigerant mixture to flow through the pipe;

an outdoor heat exchanger, the outdoor heat exchanger including fins, a plurality of heat transfer tubes penetrating through the fins and forming a part of the pipe, and a bend portion connecting two of the heat transfer tubes, the bend portion being accommodated inside the casing, and comprising a breakage-guide portion having a pressure resistance lower than a pressure resistance of rest of the pipe; and a plate interposed between the breakage-guide portion and outside of the casing, wherein the breakage-guide portion has a small-thickness portion having a thickness smaller than a thickness of the bend portion at a part other than the small-thickness portion, and wherein the small-thickness portion is provided over an entire periphery of the bend portion in a circumferential direction of the bend portion.

2. The outdoor unit of claim 1, wherein the casing includes an air-sending chamber having an air inlet and an air outlet, and a machine chamber partitioned from the air-sending chamber, and wherein the breakage-guide portion is accommodated inside the machine chamber.

3. The outdoor unit of claim 1, wherein a ratio of the 1,1,2-trifluoroethylene to the refrigerant mixture is equal to or less than 35 wt %, and wherein the breakage-guide portion is configured to break at a pressure of from 10 MPa to 15 MPa.

4. The outdoor unit of claim 1, wherein, when the thickness of the small-thickness portion is t3, and the thickness of the bend portion at the part other than the small-thickness portion is t4, $t3/t4 \leq 0.7$ is satisfied.

* * * * *